US008427401B2

(12) United States Patent
Kasai

(10) Patent No.: US 8,427,401 B2
(45) Date of Patent: Apr. 23, 2013

(54) ELECTRO-OPTICAL DEVICE AND METHOD FOR DRIVING THE SAME BY APPLYING A CAPACITANCE CHARGE, AND ELECTRONIC APPARATUS

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 320 days.

(21) Appl. No.: 12/761,769

(22) Filed: Apr. 16, 2010

(65) Prior Publication Data

US 2010/0265221 A1 Oct. 21, 2010

(30) Foreign Application Priority Data

Apr. 20, 2009 (JP) ..... 2009-101768

(51) Int. Cl.
*G09G 5/00* (2006.01)

(52) U.S. Cl.
USPC ..... 345/76; 345/82

(58) Field of Classification Search ..... 345/39, 345/46, 76, 205, 213; 315/169.1
See application file for complete search history.

(56) References Cited

U.S. PATENT DOCUMENTS

| | | | | |
|---|---|---|---|---|
| 6,765,560 | B1 | 7/2004 | Ozawa | |
| 6,861,810 | B2 * | 3/2005 | Rutherford | 315/169.3 |
| 2001/0054711 | A1 * | 12/2001 | Numao | 257/72 |
| 2009/0195534 | A1 | 8/2009 | Kasai | |

FOREIGN PATENT DOCUMENTS

JP A-2000-122608 4/2000

* cited by examiner

*Primary Examiner* — Chanh Nguyen
*Assistant Examiner* — Jonathan Blancha
(74) *Attorney, Agent, or Firm* — Oliff & Berridge, PLC

(57) ABSTRACT

An electro-optical device includes a plurality of element driving lines, a plurality of unit circuits, an element driving circuit, and a data line driving circuit. The data potential corresponds to gray scale data of the unit circuit for the element driving line. Each of the plurality of unit circuits includes a capacitive element and an electro-optical element. The electro-optical element is driven in such a manner that a potential difference is generated by supplying a potential to the element driving line.

11 Claims, 8 Drawing Sheets

ELECTRO-OPTICAL DEVICE AND METHOD FOR DRIVING THE SAME BY APPLYING A CAPACITANCE CHARGE, AND ELECTRONIC APPARATUS

BACKGROUND

1. Technical Field

The present invention relates to an electro-optical device including an organic EL (electro luminescent) element, a liquid crystal and the like and a method for driving the electro-optical device, and an electronic apparatus.

2. Related Art

In the past, there has been provided an electro-optical device including an organic EL element as an electro-optical element. The electro-optical device includes various driving circuits for supplying a predetermined current or voltage to the organic EL element and the like. Such a driving circuit may include, in addition to the organic EL element, for example, a capacitive element connected in parallel with the organic EL element. In this case, data potential is given to a positive electrode of the organic EL element and one electrode of the capacitive element, and a reference potential is given to a negative electrode of the organic EL element and the other electrode of the capacitive element. According to such configuration, electric charge accumulated in the capacitive element based on the data potential is given to the organic EL element, thereby enabling a stable driving of the organic EL element.

An example of such an electro-optical device is disclosed in JP-A-2000-122608.

In the electro-optical device described above, in order to obtain a sufficient amount of luminescence (time integral value of luminescence) of the organic EL element, a charge amount accumulated in the capacitive element needs to be large; thus, the capacitive element needs to be very large in capacity. However, because an area physically permitted for arranging each driving circuit may be limited, the capacitive element having such a large capacity is difficult to be achieved in the first place.

The present applicant already has proposed a technique disclosed in U.S. Patent Application Publication No. 2009/0195534, in which a capacitive element included in each of a plurality of driving circuits (unit circuits) is used for driving one organic EL element. For example, assuming that the driving circuits are arrayed in one row, the number of the driving circuits is N (therefore, N capacitive elements and N organic EL elements are provided correspondingly). When a certain organic EL element is driven, first, the N capacitive elements included in all the driving circuits are simultaneously charged in accordance with the data potential corresponding to the relevant organic EL element, and subsequently, the N capacitive elements are simultaneously discharged (i.e., current is supplied) for the relevant organic EL element.

With the above-described configuration, the above mentioned difficulties can be reduced.

However, further improvement is desired in such a technique.

That is, in the above example of JP-A-2000-122608, an example is disclosed in which a switching element is arranged between the capacitive element and the organic EL element in each driving circuit. The switching element is an element which is first (i.e., in the simultaneous charging) held in a non-conducted state, and subsequently (i.e., in the simultaneous discharging) in a conducted state to suitably charge the capacitive element and supply current to the organic EL element by the discharge therefrom.

However, the switching element is basically provided to each of the driving circuits. Accordingly, it may be difficult to have the quality and characteristics in a predetermined range for all the driving circuits. If undesired variations are generated in the quality, characteristics and the like, a performance of the entire electro-optical device (e.g., maintaining and improving image quality) may be affected. Moreover, the necessity for providing the switching element itself may reduce the yield in the first place.

SUMMARY

An advantage of some aspects of the invention is to provide an electro-optical device and a method for driving the electro-optical device and an electronic apparatus which can solve at least a part of the above problems.

In addition, in accordance with an aspect of the invention, provided is an electro-optical device and a method for driving the electro-optical device and an electronic apparatus which can solve the problems related to the electro-optical device, and the method for driving the electro-optical device and the electronic apparatus.

An electro-optical device according to an aspect of the invention includes: a plurality of element driving lines extending at an interval between the lines; a plurality of unit circuits arranged corresponding to intersections between the plurality of element driving lines and a plurality of data lines; an element driving circuit which sequentially supplies a first potential to the element driving lines during a period of driving in each unit period; and a data line driving circuit which outputs to each of the data lines a data potential during a period of writing before the period of driving in each unit period, the data potential corresponding to gray scale data of the unit circuit for the element driving line supplied with the first potential during the period of driving in the unit period. Each of the plurality of unit circuits includes a capacitive element which has a first electrode as a reference potential and a second electrode connected to one of the data lines, and an electro-optical element which has a third electrode connected to the second electrode and a fourth electrode connected to one of the element driving lines and has a gray scale level corresponding to the data potential. The electro-optical element is driven in such a manner that a potential difference, which is defined by the data potential and the first potential, is generated between the third electrode and the fourth electrode by supplying the first potential to the element driving line.

According to the aspect of the invention, an operation as follows may be achieved.

That is, first, during the period of writing, charged is the capacitive element in the unit circuit connected to the data line. Subsequently, during the period of driving after the period of writing, the capacitive element charged first is discharged for the electro-optical element included in the unit circuit corresponding to one of the element driving lines having been supplied with the first potential. In this case, according to the above description, assumed is the third electrode of the electro-optical element is given the data potential and the fourth electrode is given the first potential, resulting in that a forward voltage is applied to the electro-optical element and the current flows therein (the phrase "is driven" includes such meaning).

According to the aforementioned configuration, driving of the electro-optical element is controlled by whether or not the element driving line is supplied with the first potential and not by whether or not the switching element as described above or the like are provided. Therefore, according to the aspect of the invention, the electro-optical device having a simplified configuration can be provided. Additionally, from the same reason, according to the aspect of the invention, an advantage can be obtained, where the yield is improved and the light-emitting characteristics of each electro-optical element are stabilized because of no need of providing the circuit element such as the switching element or the like. Further various other advantages can be obtained. For example, each unit circuit can be small in size without providing a circuit element such as a switching element, which results in high definition to be achieved.

It is preferable that the first potential be equal to or less than the data potential.

In this case, the first potential is appropriately set, thereby the advantages described above being obtained sufficiently.

It is preferable for the element driving circuit to output a second potential equal to or more than the data potential to the element driving line during the time the data line driving circuit supplies the data potential to the data line.

In this case, the second potential is not less than the data potential, thus, during the period of writing as described above, a so-called reverse voltage is applied to the electro-optical element. Therefore, the writing operation, that is, charging the capacitive element may be performed suitably without the current flowing in the electro-optical element.

It is preferable for the second potential to be defined in a range from a threshold voltage at which current begins to flow in the electro-optical element to a breakdown voltage at which the electro-optical element breaks down in current-voltage characteristics of the electro-optical element.

In this case, with the second potential described above being suitably set, the advantages described above can be efficiently obtained. Particularly, in this case, the second potential is not set to a value in a range exceeding "a breakdown voltage at which the electro-optical element breakdowns," enabling the stable operation of the entire device to be ensured.

It is preferable for an auxiliary capacitive element having one electrode connected to the data line to be further included in addition to the capacitive element in the unit circuit.

In this case, even if the total capacitance of each of the capacitive elements connected to the data line corresponding to the unit circuit is smaller than the capacitance necessary for an amount of luminescence of the electro-optical element to be sufficient in each of the unit circuits corresponding to one line included in the selected scanning line, a shortage can be compensated by the capacitance of the auxiliary capacitive element.

Further, an advantage of another aspect of the invention is to provide an electronic apparatus including any of the electro-optical devices described above to solve the problems mentioned above.

The electronic apparatus according to the invention includes any of the electro-optical devices described above, thus, a circuit element such as the switching element is unnecessary for driving the electro-optical element, resulting in such advantage that an image of higher quality can be displayed or the like.

An advantage of further aspect of the invention is to provide a method for driving an electro-optical device, the electro-optical device including a plurality of element driving lines extending at an interval between the lines and a plurality of unit circuits arranged corresponding to intersections between the plurality of element driving lines and a plurality of data lines, and each of the plurality of unit circuits including a capacitive element which has a first electrode as a reference potential and a second electrode connected to one of the data lines and an electro-optical element which has a third electrode connected to the second electrode and a fourth electrode connected to one of the element driving lines, and has a predetermined gray scale level by discharge of the electro-optical element. The method includes: accumulating charge corresponding to the data potential to the capacitive element which is connected to the data line by supplying the data potential to the data line; and driving the electro-optical element by supplying the element driving line with a first potential to generate a potential difference, which is defined by the data potential and the first potential, between the third electrode and the fourth electrode.

In this case, the electro-optical element is controlled by whether or not the element driving line is given the first potential and not by whether or not the switching element as described above or the like are provided. Therefore, in this case, obtained are advantages substantially the same as the advantages obtained in the "electro-optical device" described above.

Moreover, as is obvious, the electro-optical device according to the aspects of the invention can be preferably driven.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention is described with reference to FIG. 1 and FIG. 2. Note that in addition to FIG. 1 and FIG. 2 referred to here, the drawings referred to below may show parts with a dimensional ratio different from the actual ratio.

Figure 1:
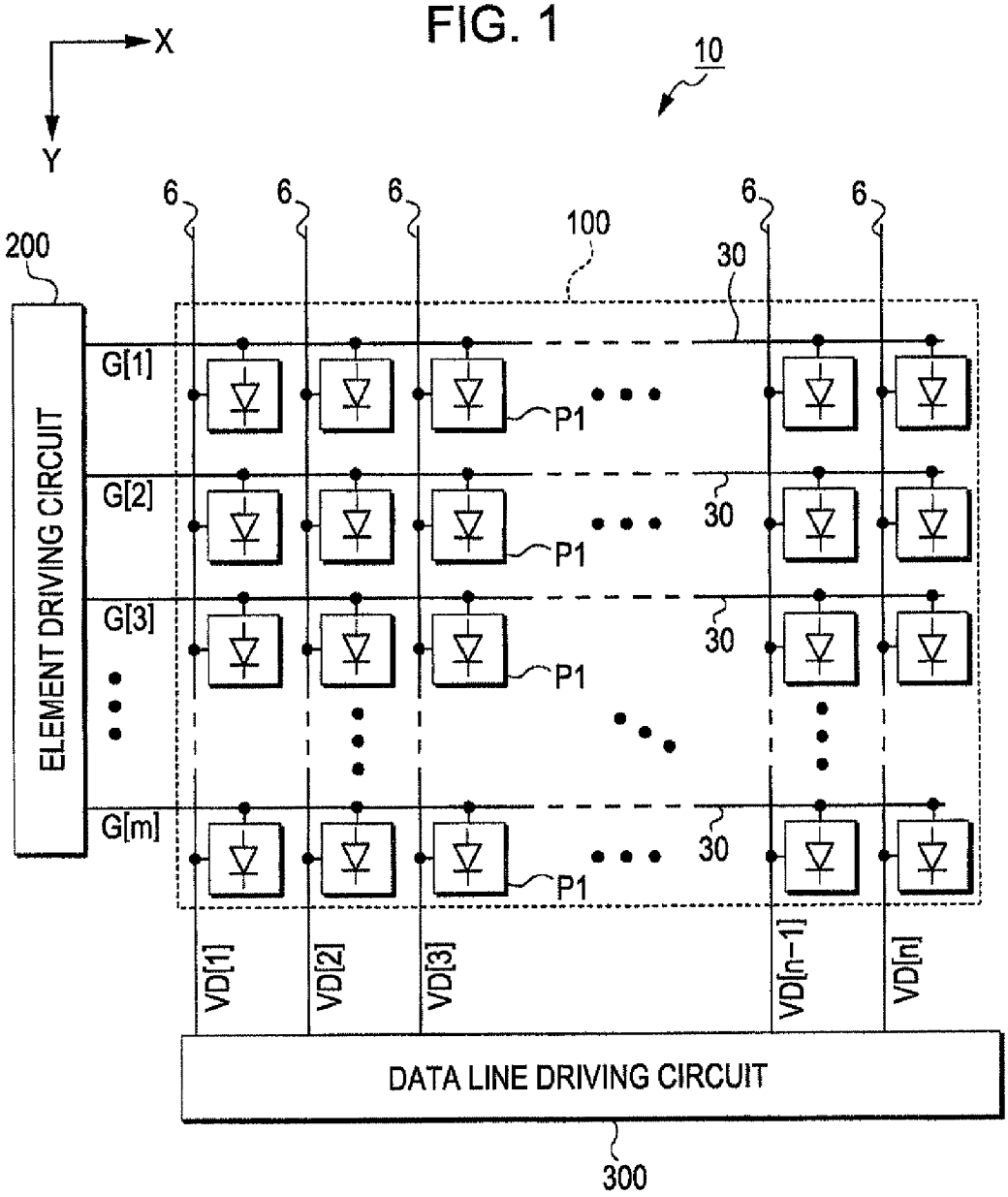
FIG. 1 is a block diagram illustrating an electro-optical device according to an embodiment of the invention.

As shown in FIG. 1, an electro-optical device 10 is a device used in various electronic apparatuses as a unit which displays an image, and includes a pixel array part 100 having a plurality of unit circuits P1 in a two-dimensional array, an element driving circuit 200, and a data line driving circuit 300. Note that in FIG. 1, the element driving circuit 200 and the data line driving circuit 300 are shown as separate circuits; however, a part or all of the circuits may be configured in a single circuit.

As shown in FIG. 1, the pixel array part 100 is provided with m element driving lines 30 extending in an X direction and n data lines 6 extending in a Y direction perpendicular to the X direction (m and n are natural numbers). Each unit circuit P1 is arranged at a position corresponding to an intersection between the element driving line 30 and the data line 6. Therefore, these unit circuits P1 are arranged in a matrix of m rows×n columns.

Figure 2:
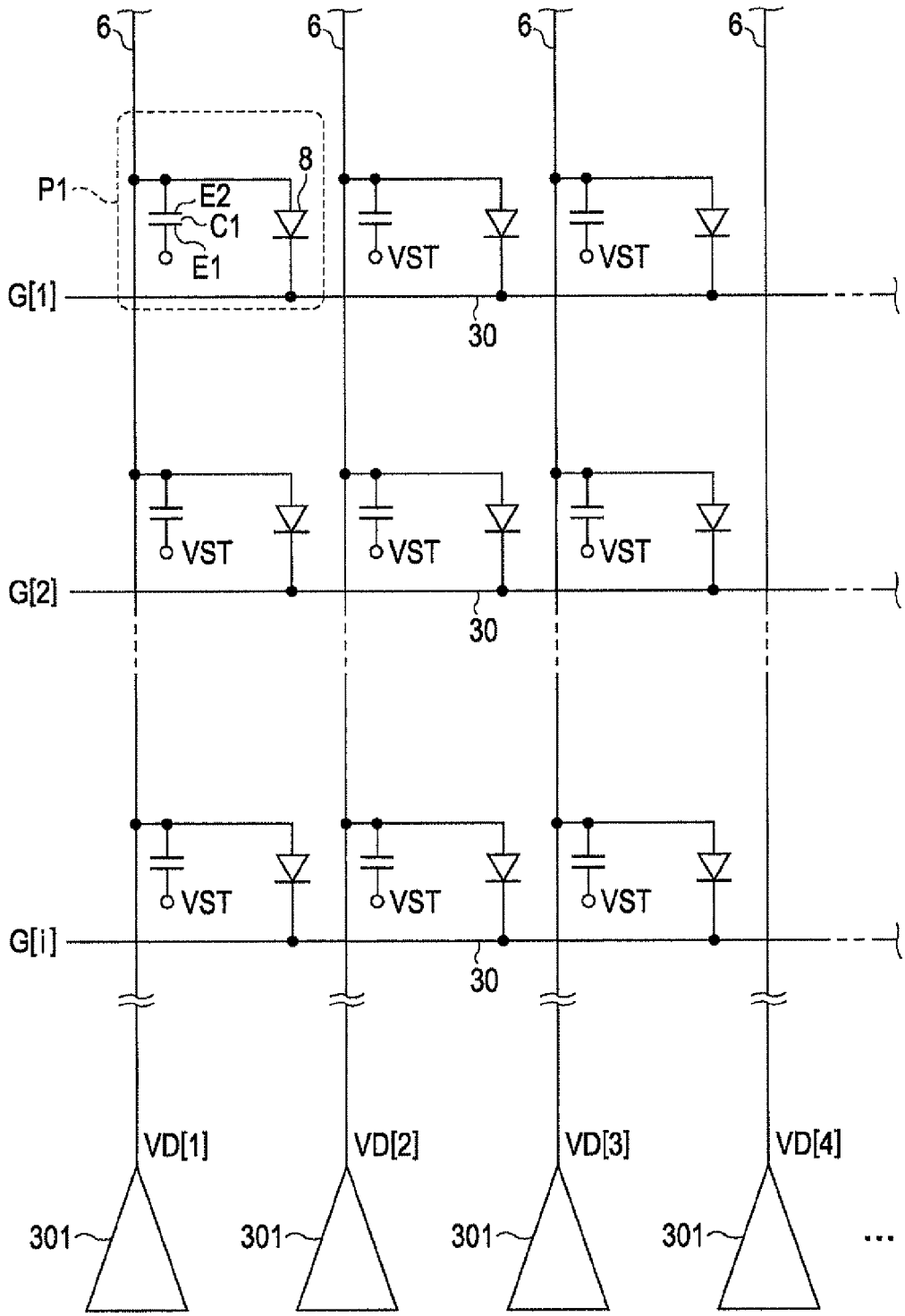
FIG. 2 is a circuit diagram illustrating details around a unit circuit and a data potential generating part constituting the electro-optical device of FIG. 1.

In the above configuration, the m element driving lines 30 are one of characteristic components of the embodiment of the invention, and are each directly connected to an electro-optical element 8 as shown in FIG. 2 (this is described later).

The element driving circuit 200 shown in FIG. 1 is a circuit which drives sequentially the electro-optical elements 8 in the plurality of unit circuits P1. The element driving circuit 200 generates driving signals G(1) to G(m) to be activated sequentially, and outputs each signal to the corresponding one of the above described element driving lines 30. A transition to an active state of the driving signal G(i) supplied to the $i^{th}$ element driving line 30 (i is an integer satisfying $1 \leqq i \leqq m$) means that the electro-optical elements 8 included in the n unit circuits P1 belonging to the $i^{th}$ horizontal row are selected to be driven.

In the followings, an operation that a certain element driving line 30 is supplied with the driving signal G(i) in the active state may be referred to as "select" of the element driving line 30. Note that the term "select" may be used also for the unit circuit P1 or electro-optical element 8 corresponding to the element driving line 30.

The data line driving circuit 300 shown in FIG. 1 generates the data potentials VD(1) to VD(n) corresponding to gray scale data of the n unit circuits P1 corresponding to the element driving line 30 selected by the element driving circuit 200 and outputs each data potential to the corresponding one of the data lines 6. As shown in FIG. 2, the data line driving circuit 300 may include data potential generating portions 301 for generating and supplying the corresponding data potentials VD(1) to VD(n). Note that in the followings, the data potential VD output to a $j^{th}$ data line 6 (j is an integer satisfying $1 \leqq j \leqq n$) may be represented as VD(j).

FIG. 2 is a circuit diagram illustrating a detailed electrical configuration of each unit circuit P1.

Each unit circuit P1 includes the electro-optical element 8 and a capacitive element C1 as shown in FIG. 2.

The electro-optical element 8 is an OLED (Organic Light Emitting Diode) having a light-emitting layer of organic EL material interposed between a positive electrode and a negative electrode, and arranged between the element driving lines 30 and the data lines 6 as shown in FIG. 2. Here, the positive electrode is an individual electrode which is provided in each of the unit circuits P1 and controlled in each unit circuit P1. Further, the negative electrode is a common electrode which is provided to one horizontal row of unit circuits P1 and shared with the unit circuits P1; the common electrode corresponds to the element driving line 30.

The capacitive element C1 is a unit which maintains the data potential VD(j) supplied from the data line 6. As shown in FIG. 2, the capacitive element C1 includes a first electrode E1 at a reference potential VST and a second electrode E2 connected to the data line 6.

The second electrode E2 is also connected to the positive electrode of the above-described electro-optical element 8. Accordingly, whether the current flows in the electro-optical element 8 depends on a correlation between the potential of the second electrode E2 and the potential of the element driving line 30 connected to the negative electrode of the relevant electro-optical element 8. Specifically, if a difference between both potentials is equal to or more than a certain level, and a direction thereof is a forward bias, the current flows in the electro-optical element 8. If the difference between both potentials is lower than a certain level, or a direction thereof is a reverse bias, the current does not flow in the electro-optical element 8. However, in the latter case (reverse bias), a problem may occur in the electro-optical element 8. Such problem will be described later with reference to FIG. 4.

In either case, the potential of the second electrode E2 depends on the data potential; therefore, the electro-optical element 8 may emit light at a gray scale level corresponding to the data potential.

Next, an operation and function of the electro-optical device 10 of the embodiment will be described with reference to FIG. 3 to FIG. 6 in addition to FIG. 1 and FIG. 2 which were already referred to.

The electro-optical device 10 basically performs writing operation and light-emitting operation below.

Writing Operation

The writing operation is that the data potential VD(j), which corresponds to the light-emitting gray scale level for the electro-optical element 8 included in each of the unit circuits P1 corresponding to the selected element driving line 30, is held in the capacitive elements C1 of the unit circuits P1 which belong to the vertical column including the relevant electro-optical element 8. For example, the data potential VD(3) of the electro-optical device 8 which corresponds to the second element driving line 30 and located at the third vertical column (see FIG. 1) is held in a plurality of capacitive elements C1 in the unit circuits P1 located at the third vertical column.

Light-Emitting Operation (Driving of Electro-Optical Element)

The light-emitting operation is that the relevant electro-optical element 8 is made to emit light based on the data potential VD(j) held in the capacitive elements C1 in the writing operation. This operation includes supplying the driving signal G(i) of active state to the element driving line 30 corresponding to the unit circuit P1 including the relevant electro-optical element 8, and thereby causing the current to flow in the electro-optical element 8 of the unit circuit P1. Thus, the electro-optical element 8 is supplied with the current corresponding to the charge accumulated in the capacitive element C1, and emits light.

The electro-optical device 10 of the embodiment basically performs the above writing operation and light-emitting operation appropriately combined. The details of the operation are as follows.

Figure 3:
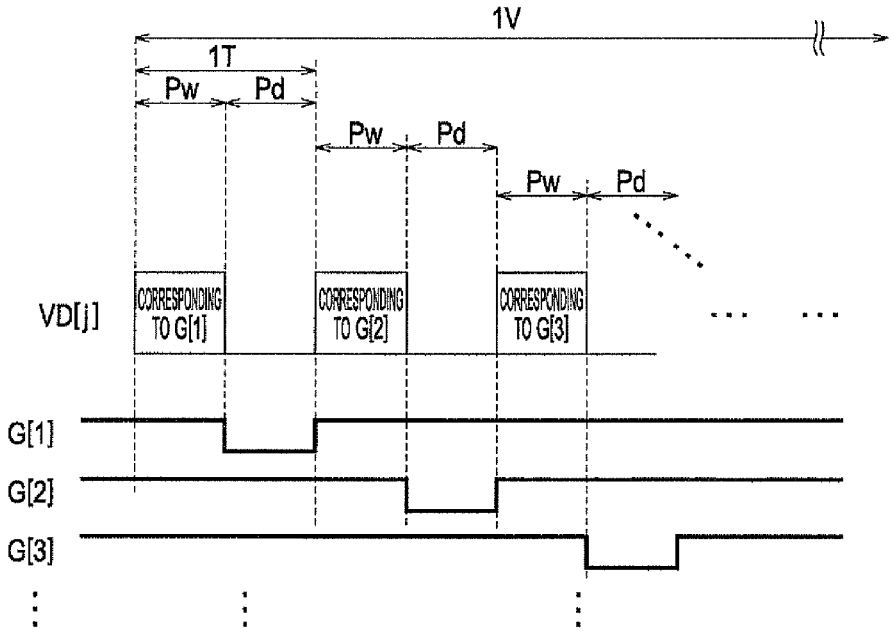
FIG. 3 is a timing chart illustrating an operation of the electro-optical device illustrated in FIG. 1 and FIG. 2.

First, during a period of writing Pw shown in FIG. 3 at the leftmost portion, the data potential generating part 301 in the data line driving circuit 300 generates the data potentials VD(1), VD(2), . . . and, VD(n), and individually supplies the data potentials to the corresponding data lines 6. The data potential VD(j) corresponds to the electro-optical element 8 of each of the unit circuits P1 located at the first horizontal row (refer to a representation "corresponding to G(1)" in FIG. 3).

Furthermore, in this case, the element driving circuit 200 supplies the element driving line 30 of the first horizontal row with the driving signal G(1) in a non-active state (driving signal G(1) at a high level in FIG. 3). The potential of the driving signal G(1) in the non-active state has a value exceeding the data potential VD(j) of the maximum value, VD(j)max (hereinafter, may be referred to as "maximum data potential VD(j)max") as shown in FIG. 4.

Figure 4:
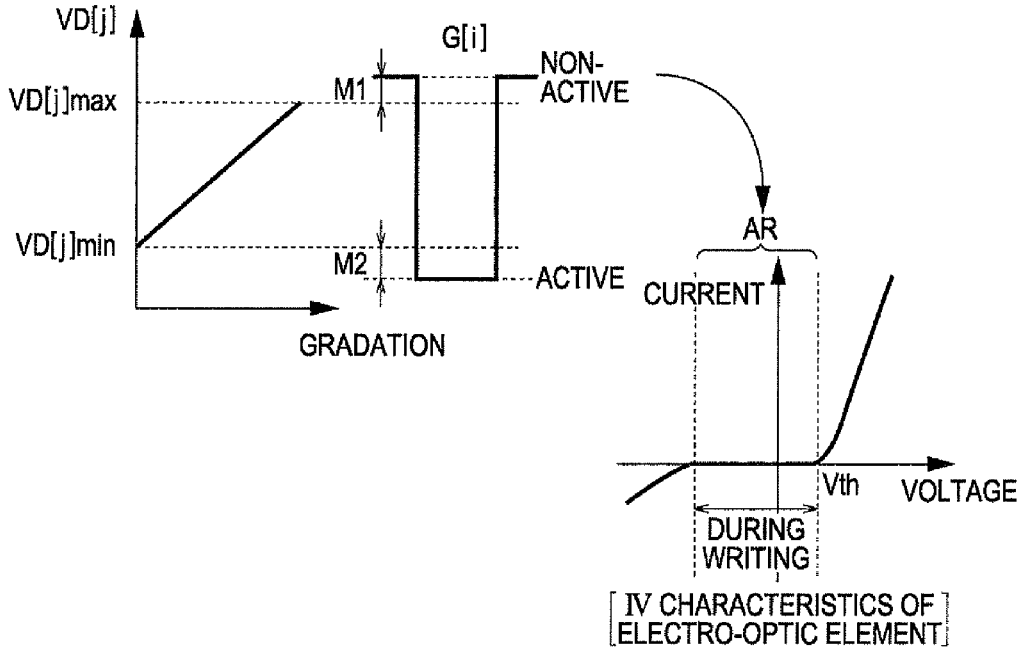
FIG. 4 is a diagram illustrating a relationship between the level of a driving signal G(i) and a data potential VD(j) shown in FIG. 3.

Note that the left portion of FIG. 4 shows a graph representing a relationship between the light-emitting gray scale level and the data potential VD(1). The graph shows a condition where as the light-emitting gray scale level rises, the data potential VD(j) proportionally rises from a data potential VD(j) of the minimum value, VD(j)min (hereinafter, may be referred to as "minimum data potential VD(j)min") to the above described maximum data potential VD(j)max. The lower right portion of FIG. 4 shows current-voltage characteristics of the electro-optical element 8, the meaning of which will be described later.

As described above, during the period of writing Pw, the positive electrode of the electro-optical element 8 is given the data potential VD(j), whereas the negative electrode is given a positive potential; thus, a voltage of reverse bias is applied to the relevant electro-optical element 8, and the current does not flow.

Figure 5:
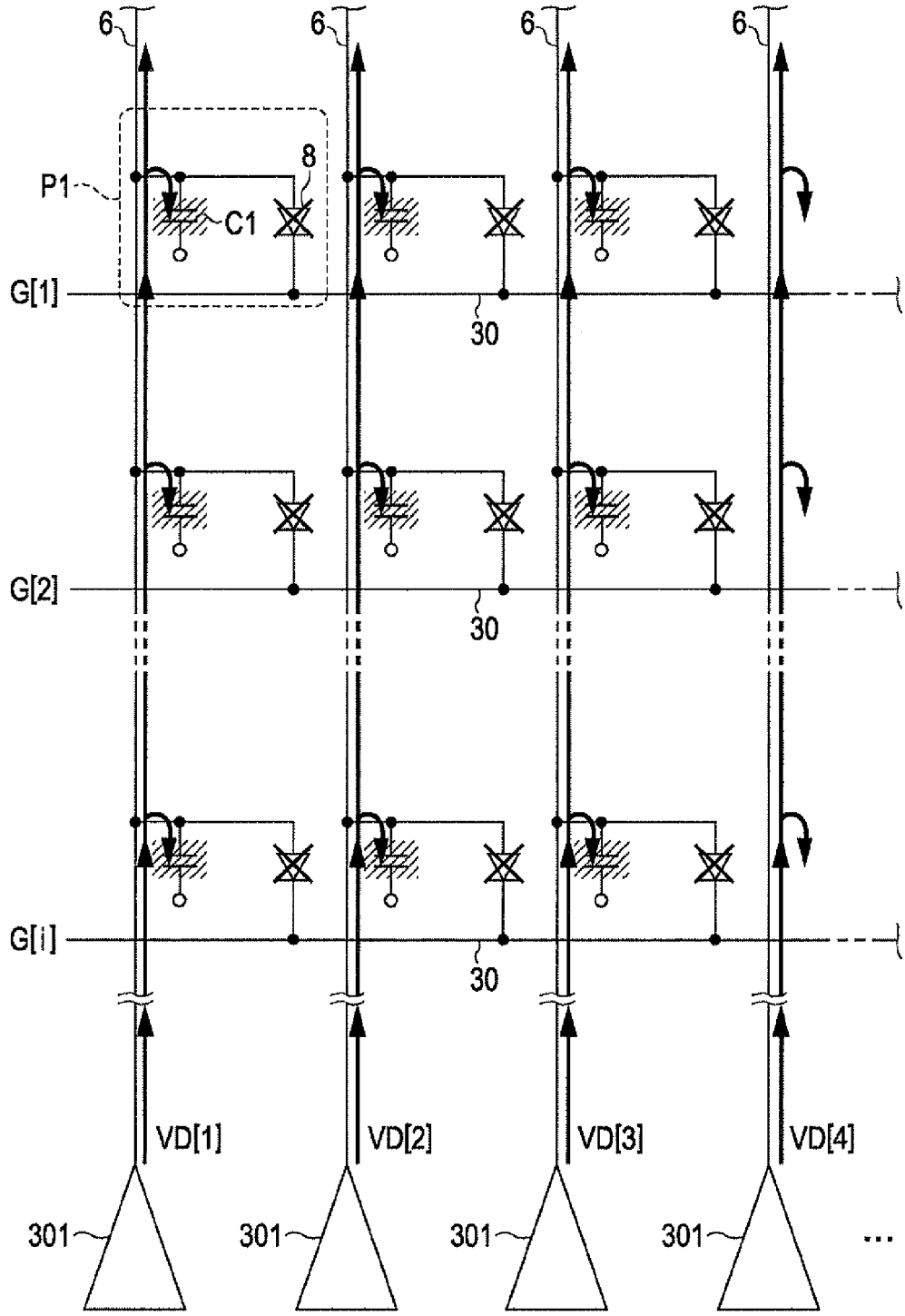
FIG. 5 is an illustration (1) visually representing a charge and discharge of a capacitive element (C1) in the electro-optical device operating in accordance with the flowchart illustrated in FIG. 3.

FIG. 5 shows the above operations visually. That is, FIG. 5 shows a case where a plurality of capacitive elements C1 belonging to a data line 6 accumulate the charge corresponding to VD(1), VD(2), . . . , or VD(n) (refer to arrows of heavy and solid lines, hatched portions associated therewith and the like in FIG. 5). In this case, the current does not flow in the electro-optical element 8 (refer to cross marks in FIG. 5).

In this way, the writing operation is completed for the electro-optical element 8 of each of the unit circuits P1 located on the first horizontal row.

Subsequently, as shown in FIG. 3, during a period of driving Pd adjacent to the period of writing Pw, the element driving circuit 200 supplies the element driving line 30 of the first horizontal row with the driving signal G(1) in the active state (driving signal G(1) of low level in FIG. 3). The potential of the driving signal G(1) in the active state has a value below the above-mentioned minimum data potential VD(j)min as shown in FIG. 4. Therefore, during the period of driving Pd, the positive electrode of the electro-optical element 8 is given the data potential VD(j), whereas the negative electrode is given a negative potential. Thus, a voltage of forward bias is applied to the relevant electro-optical element 8, and the current flows therein. The amount of the current depends on the magnitude of the data potential VD(j). Further, in this case, the current flowing in the relevant electro-optical element 8 depends on the charge accumulated in the plurality of capacitive elements C1 described above.

In this way, the electro-optical elements 8 corresponding to the element driving line 30 of the first horizontal row simultaneously emits light (the above light-emitting operation). Furthermore, with this, one unit period 1T ends (refer to the upper portion in FIG. 3).

Figure 6:
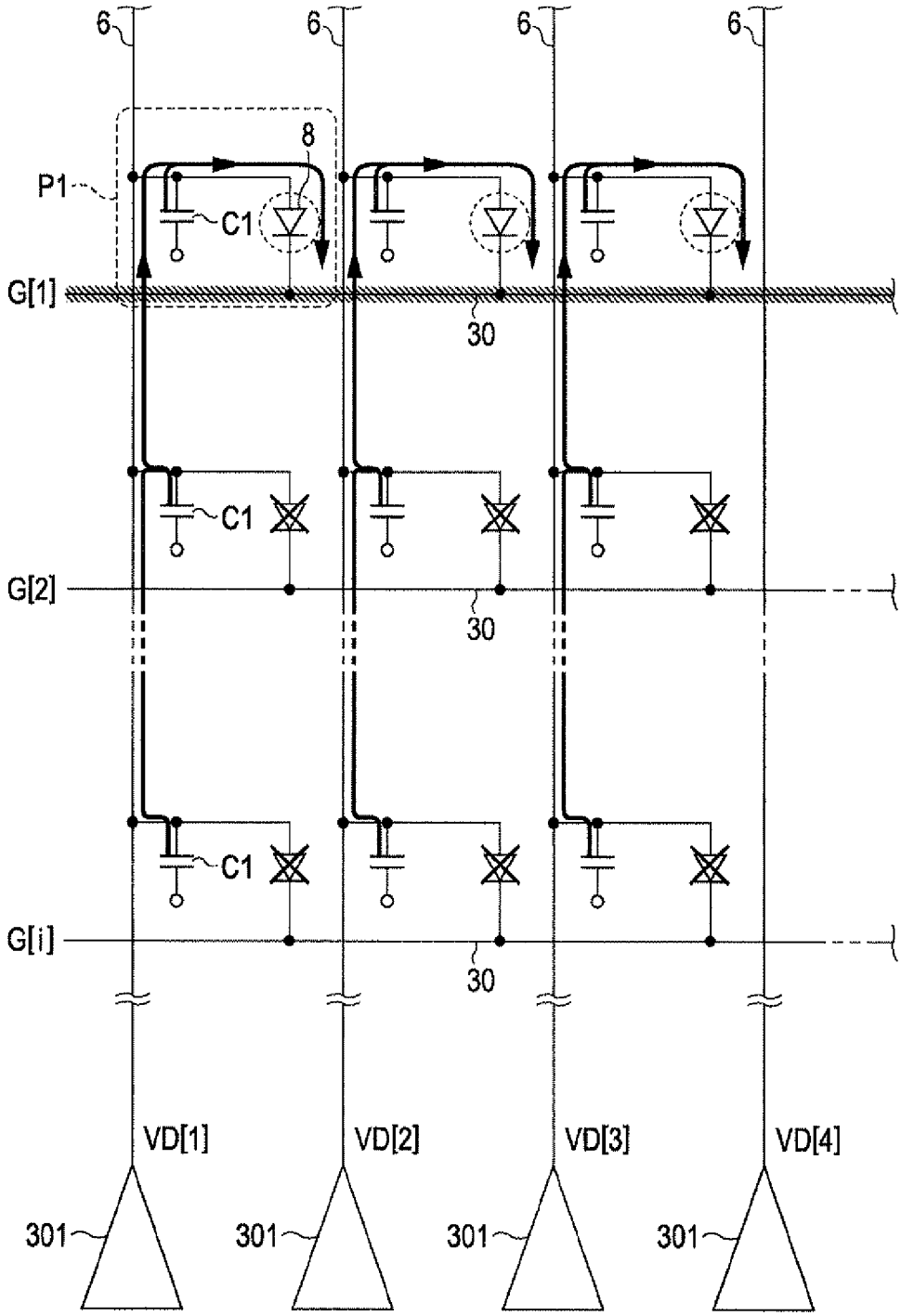
FIG. 6 is an illustration (2) visually representing a charge and discharge of the capacitive element (C1) in the electro-optical device operating in accordance with the flowchart illustrated FIG. 3.

FIG. 6 shows the above operations visually. That is, FIG. 6 shows a case where the element driving line 30 of the first horizontal row is supplied with the driving signal G(1) in the active state. Each of the electro-optical elements 8 belonging to the element driving line 30 becomes a so-called on-state, and emits light. Moreover, a case is shown where at that time, the relevant electro-optical element 8 is supplied with the current corresponding to the charge of the plurality of capacitive elements C1 belonging to the respective lines described above (refer to arrows of heavy and solid lines, hatched portions associated therewith and the like in FIG. 6).

After that, the operations described above are repeated with the electro-optical elements 8 to emit light being sequentially shifted downwards in FIG. 5 and FIG. 6 (or in FIG. 1 and FIG. 2).

Note that a period 1V shown in FIG. 3 means one vertical scanning period in which line selection operation is made for all the element driving lines 30.

According to the electro-optical device 10 of the embodiment having such a configuration and operation, the advantages as follows are achieved.

That is, according to the electro-optical device 10 of the embodiment, the electro-optical elements 8 emit or does not emit light depending on the state of the driving signal G(i) supplied to the element driving line 30. Therefore, for example, there is no need to provide a switching element such as a TFT in addition to the above configuration, enabling the electro-optical device having a simplified configuration to be provided.

Figure 7:
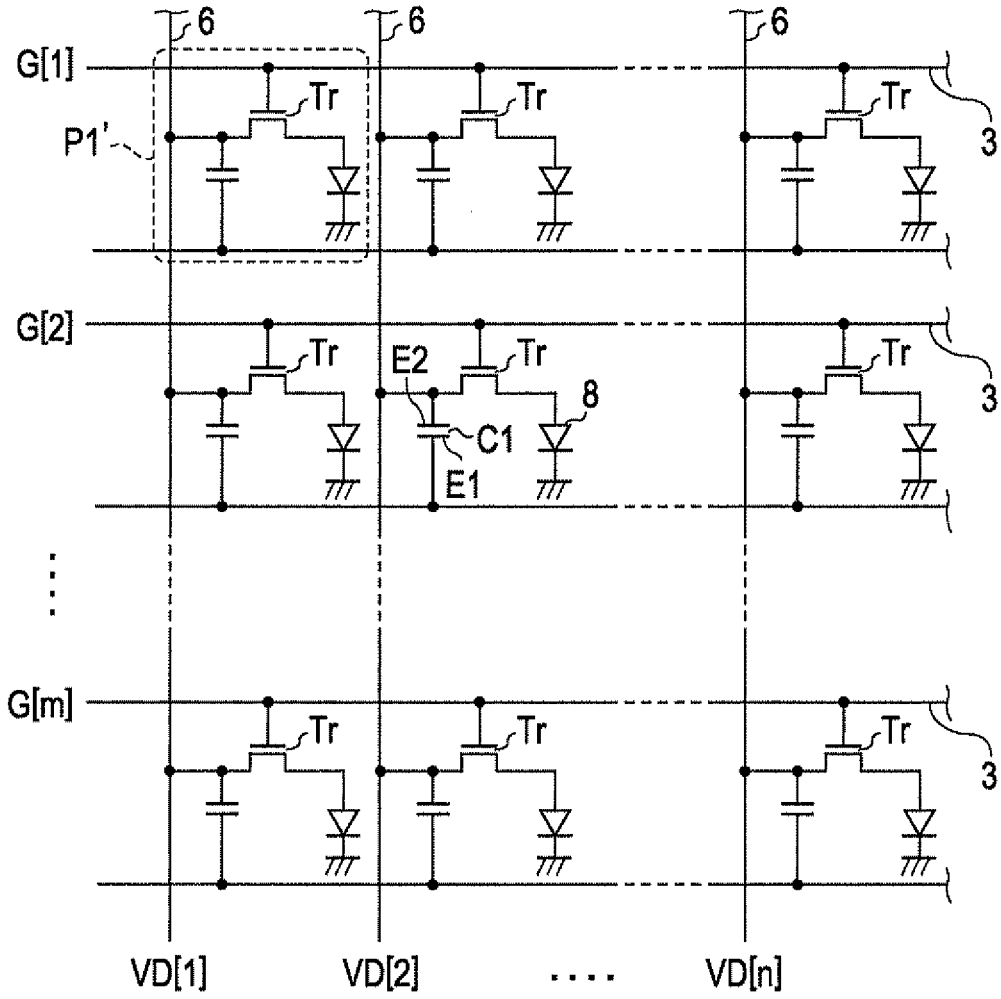
FIG. 7 illustrates a configuration of a comparative example as compared to a configuration of the electro-optical device according to the embodiment of the invention.

This can be comprehended more clearly by comparing such configuration according to the embodiment with that illustrated in FIG. 7. FIG. 7 is a comparative example for the configuration of the embodiment (compared with FIG. 2).

As shown in FIG. 7, each unit circuit P1' includes a transistor Tr unlike the unit circuit P1 illustrated in FIG. 1, FIG. 2 and other figures. The transistor Tr is an N-channel type switching element which is electrically conducted on selecting a scanning line 3 and causes the second electrode E2 of the capacitive element C1 to conduct with the electro-optical element 8. The source of the transistor Tr is connected to the positive electrode of the electro-optical element 8 and the drain thereof is connected to the second electrode E2 of the capacitive element C1.

In FIG. 7 with such a configuration, whether the electro-optical element 8 emits or does not emit light depends on whether or not the transistor Tr is in a conducted state. Specifically, the transistor Tr maintains the non-conducted state when the capacitive element C1 is charged, and becomes the conducted state when the capacitive element C1 is discharged.

However, in such a configuration of the comparative example, the transistor Tr basically needs to be provided to all the unit circuits P1'; thus, it is not easy to keep the quality and characteristics thereof in a predetermined range for all the unit circuits P1'. If undesired variations are caused in the quality, characteristics and the like, a performance of the entire electro-optical device may be affected. Moreover, the yield may be decreased due to the necessity for providing the transistor Tr itself.

As is obvious also from the above comparison, according to the embodiment in which the transistor Tr is unnecessary, there is no risk described above that is caused by providing the transistor Tr.

Additionally, according to the embodiment, various advantages can be obtained, for example, the yield is improved or the light-emitting characteristics of each electro-optical element 8 are stabilized because of the unnecessity of providing a circuit element such as the transistor Tr, and each unit circuit can be small in size without providing a circuit element such as the transistor Tr, which results in high definition to be achieved.

Note that the above description is given of the potential in the cases where the driving signal G(i) is in the active and non-active states with reference to FIG. 4. As for this point, it is more preferable if the condition as described below be satisfied.

FIG. 4 shows at the lower right portion the current-voltage characteristics of the electro-optical element 8 as already described. As shown in the figure, if the voltage of forward bias is applied to the electro-optical element 8, the current starts to increase at the point where the voltage exceeds a predetermined threshold voltage $V^{th}$. On the other hand, when the voltage of reverse bias is applied, the current does not flow basically, but in the case where a magnitude of the voltage becomes equal to or more than a certain level, the current may flow in the electro-optical element 8 in the reverse direction.

In view of such current-voltage characteristics of the electro-optical element 8, it is preferable that the potential of the driving signal G(i) described above be set as follows.

Specifically, first, as already described, it is preferable for the potential of the active-state driving signal G(i) to be set less than or equal to the minimum data potential VD(j)min as shown in FIG. 4, and the potential of the non-active-state driving signal G(i) to be set greater than or equal to the maximum data potential VD(j)max.

Second, even if the potential of the non-active-state driving signal G(i) exceeds the maximum data potential VD(j)max, a setting range thereof preferably falls in an area AR shown at the lower right portion in FIG. 4. Here, the area AR is defined as an area between the threshold voltage $V^{th}$ described above and the voltage generating the reverse direction current. If the potential of the non-active-state driving signal G(i) is set to fall in the area AR, the current is effectively prevented from flowing into the electro-optical element 8, and the occurrence of the reverse direction current can be extremely decreased.

The embodiment of the invention has been described. However, the electro-optical device and the pixel circuit according to the embodiment of the invention are not limited to the above described embodiment, and various modifications can be made within the scope of the invention.

In the embodiment described above, the capacitive element C1 included in the unit circuit P1 is charged in the writing operation mentioned above; however, the invention is not limited to such an embodiment.

Figure 8:
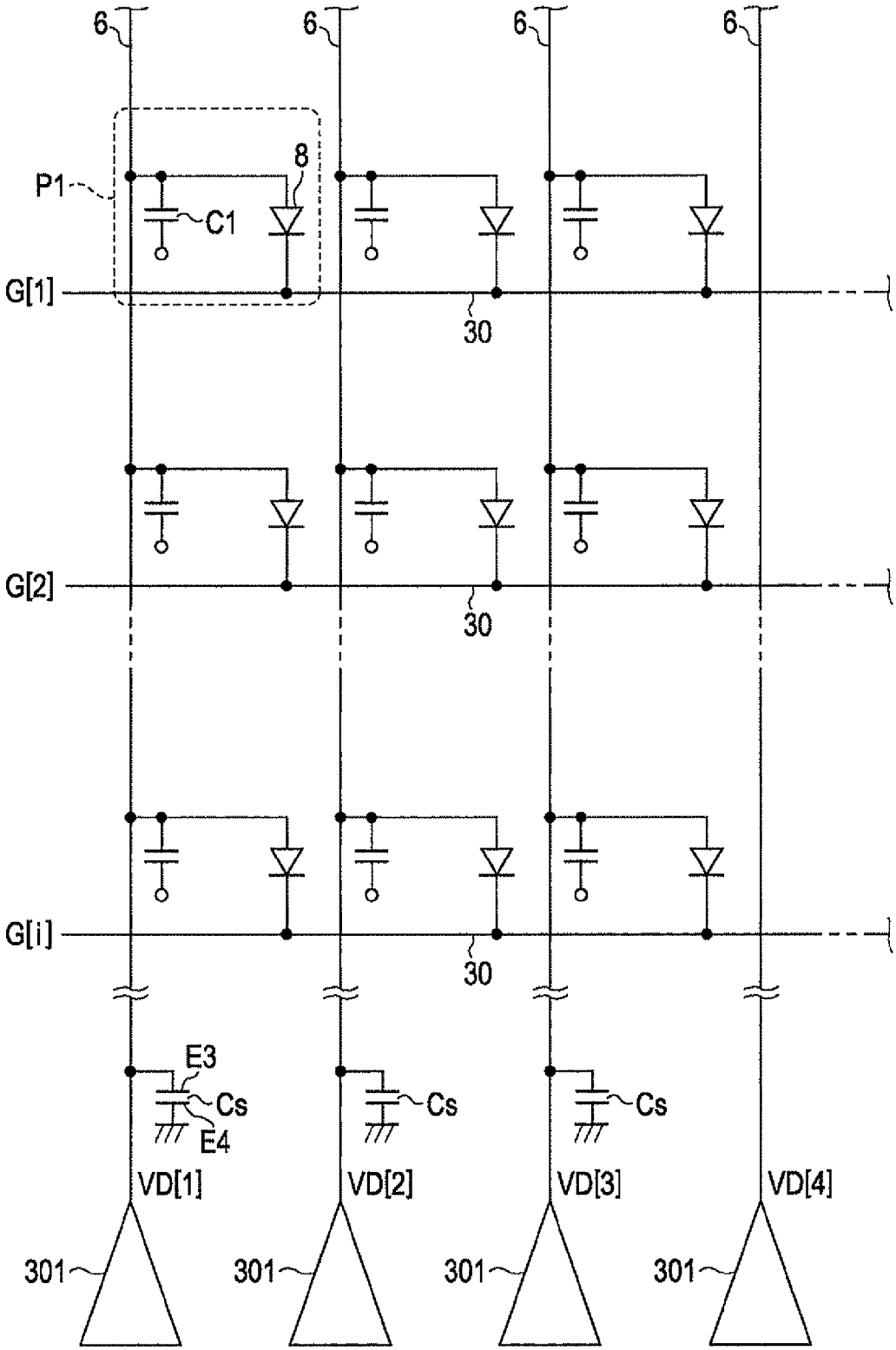
FIG. 8 is a circuit diagram illustrating details around a unit circuit and a data potential generating part constituting a modified example of the electro-optical device according to the embodiment of the invention (with auxiliary capacitive elements added).

For example, as shown in FIG. 8, the data line 6 may be connected to an auxiliary capacitive element Cs. The auxiliary capacitive element Cs has one electrode E3 connected to the data line 6 and the other electrode E4 connected to a potential line which is supplied with a fixed potential.

In the above-described modified example, during the period of writing Pw in each unit period 1T shown in FIG. 3, the auxiliary capacitive element Cs is also charged in addition to the predetermined capacitive element C1. Moreover, during the period of driving Pd in each unit period 1T shown in FIG. 3, the charge from the auxiliary capacitive element Cs is supplied to the unit circuit P1 corresponding to the relevant auxiliary capacitive element Cs.

According to the modified example, even if the total capacity of the capacitive elements C1 connected to the data line 6 corresponding to one electro-optical element 8 is not enough to make the amount of luminescence of the relevant electro-optical element 8 sufficient, the capacitance of the auxiliary capacitive element Cs can be used to compensate a shortage thereof.

Application

Next, a description will be given of an electronic apparatus using the electro-optical device 10 according to the embodiment of the invention.

Figure 9:
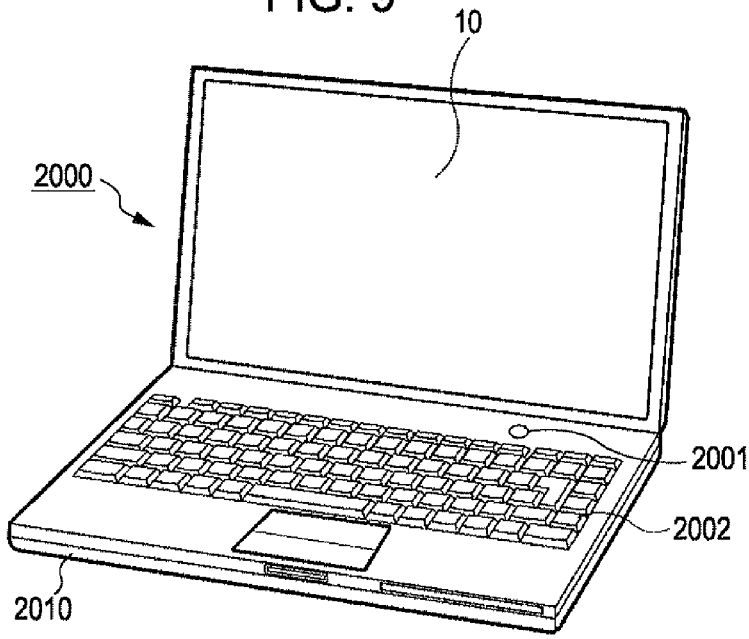
FIG. 9 is a perspective view illustrating an example of an electronic apparatus using the electro-optical device according to the embodiment of the invention.

FIG. 9 is a perspective view illustrating a configuration of a personal computer of mobile type using the electro-optical device 10 of the above embodiment as an image display device. The personal computer 2000 includes the electro-optical device 10 as a display device and a main body 2010. The main body 2010 is provided with a power switch 2001 and a keyboard 2002.

Figure 10:
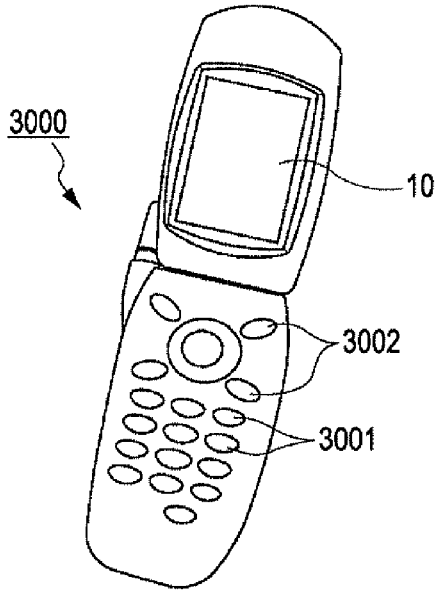
FIG. 10 is a perspective view illustrating another example of an electronic apparatus using the electro-optical device according to the embodiment of the invention.

FIG. 10 shows a mobile phone unit using the electro-optical device 10 of the above embodiment. The mobile phone unit 3000 includes a plurality of operation buttons 3001, scroll buttons 3002, and the electro-optical device 10 as a display device. The scroll buttons 3002 are operated to scroll a screen displayed on the electro-optical device 10.

Figure 11:
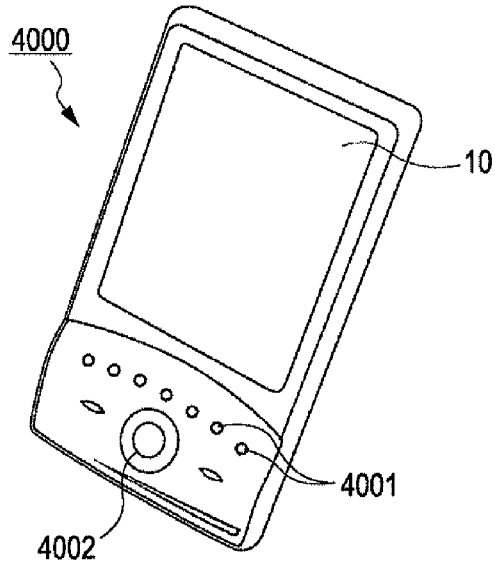
FIG. 11 is a perspective view illustrating further another example of an electronic apparatus using the electro-optical device according to the embodiment of the invention.

FIG. 11 shows a personal digital assistant (PDA) using the electro-optical device 10 of the above embodiment. The PDA 4000 includes a plurality of operation buttons 4001, a power switch 4002, and the electro-optical device 10 as a display device. The power switch 4002 is operated to display various information such as an address list and a daily planner on the electro-optical device 10.

Examples of the electronic apparatus using the electro-optical device according to the embodiment of the invention include a digital still camera, television set, video camera, car navigation system, pager, electronic data book, electronic paper, calculator, word processor, workstation, video phone system, point-of-sale terminal, video player, apparatus provided with a touch panel, and the like, in addition to those shown in FIG. 9 to FIG. 11.

This application claims priority from Japanese Patent Application No. 2009-101768 filed in the Japanese Patent Office on Apr. 20, 2009, the entire disclosure of which is hereby incorporated by reference in its entirely.

What is claimed is:

1. An electro-optical device, comprising:

a plurality of element driving lines extending at an interval between the lines;

a plurality of unit circuits arranged corresponding to intersections between the plurality of element driving lines and a plurality of data lines;

an element driving circuit which sequentially supplies a first potential to the element driving lines during a period of driving in each unit period; and a data line driving circuit which outputs to each of the data lines a data potential during a period of writing before the period of driving in each unit period, the data potential corresponding to gray scale data of the unit circuit for the element driving line supplied with the first potential during the period of driving in the unit period, wherein each of the plurality of unit circuits includes a capacitive element which has a first electrode as a reference potential and a second electrode connected to one of the data lines, and an electro-optical element which has a third electrode connected to the second electrode and a fourth electrode connected to one of the element driving lines and has a gray scale level corresponding to the data potential, and wherein the electro-optical element is driven in such a manner that a potential difference, which is defined by the difference between the first potential and the data potential accumulated in each of the capacitive elements in each of the unit circuits along the one data line, is generated between the third electrode and the fourth electrode by supplying the first potential to the element driving line.

2. The electro-optical device according to claim 1, wherein the first potential is equal to or less than the data potential.

3. An electronic apparatus comprising the electro-optical device according to claim 2.

4. The electro-optical device according to claim 1, wherein the element driving circuit outputs a second potential equal to or more than the data potential to the element driving line during the time the data line driving circuit supplies the data potential to the data line.

5. An electronic apparatus comprising the electro-optical device according to claim 4.

6. The electro-optical device according to claim 4, wherein the second potential is defined in a range from a threshold voltage at which a current begins to flow in the electro-optical element to a breakdown voltage at which the electro-optical element breakdowns in current-voltage characteristics of the electro-optical element.

7. An electronic apparatus comprising the electro-optical device according to claim 6.

8. The electro-optical device according to claim 1, further comprising an auxiliary capacitive element having one electrode connected to one of the data lines in addition to the capacitive element in the unit circuit.

9. An electronic apparatus comprising the electro-optical device according to claim 8.

10. An electronic apparatus comprising the electro-optical device according to claim 1.

11. A method for driving an electro-optical device, the electro-optical device including a plurality of element driving lines extending at a predetermined interval between the lines and a plurality of unit circuits arranged corresponding to intersections between the plurality of element driving lines and a plurality of data lines, and each of the plurality of unit circuits including a capacitive element which has a first electrode as a reference potential and a second electrode connected to one of the data lines and an electro-optical element which has a third electrode connected to the second electrode and a fourth electrode connected to one of the element driving lines, and has a predetermined gray scale level by discharge of the electro-optical element, the method comprising:

accumulating charge corresponding to the data potential to the capacitive element which is connected to the data line by supplying the data potential to the data line; and driving the electro-optical element by supplying the element driving line with a first potential and generating a potential difference, which is defined by the difference between the first potential and the data potential accumulated in each of the capacitive elements in each of the unit circuits along the data line, between the third electrode and the fourth electrode.

* * * * *